US006575591B1

(12) United States Patent
De Lany

(10) Patent No.: US 6,575,591 B1
(45) Date of Patent: Jun. 10, 2003

(54) LOW VOLTAGE DECORATIVE THEME OUTDOOR LIGHTS

(76) Inventor: William H. De Lany, 7131 Little Harbor Dr., Hungtington Beach, CA (US) 92648

( * ) Notice: Subject to any disclaimer, the term of this patent is extended or adjusted under 35 U.S.C. 154(b) by 0 days.

(21) Appl. No.: 10/177,348

(22) Filed: Jun. 21, 2002

Related U.S. Application Data

(60) Provisional application No. 60/301,487, filed on Jun. 29, 2001.

(51) Int. Cl.[7] ..... F21W 131/109

(52) U.S. Cl. ..... 362/153; 362/145; 362/153.1; 362/311; 362/351

(58) Field of Search ..... 362/153, 153.1, 362/145, 351, 355, 356, 311, 806

(56) References Cited

U.S. PATENT DOCUMENTS 3,560,731 A * 2/1971 Burton ..... 240/11.2
D248,594 S * 7/1978 Tirsbier ..... D48/35
4,268,896 A * 5/1981 Mann ..... 362/311
5,384,694 A * 1/1995 Yang ..... 362/298
5,406,466 A * 4/1995 Stokes ..... 362/153.1
D389,938 S * 1/1998 Pink et al. ..... D26/68
6,450,657 B1 * 9/2002 Testa et al. ..... 362/31

* cited by examiner

*Primary Examiner*—Laura K. Tso
(74) *Attorney, Agent, or Firm*—Roger A. Marrs

(57) ABSTRACT

A low voltage lamp having an internal illumination device which serves as a base for mounting a detachable hood supporting a fixed skirt. The hood and skirt are arranged in spaced-apart relationship having a diameter exceeding the diameter of the illumination device and its base. A decorative cylinder or sleeve is mountable between the peripheral edge of the skirt and the edge marginal region of the hood. Spacers may be provided for placing the sleeve between the hood and the skirt, while resilient fasteners detachably couple the hood to a support on the illuminating device base so that the decorative sleeve is releasably held between the hood and the skirt. The external surface of the sleeve carries a variety of indicia, pictures, or graphic representations.

7 Claims, 1 Drawing Sheet

FIG. 1
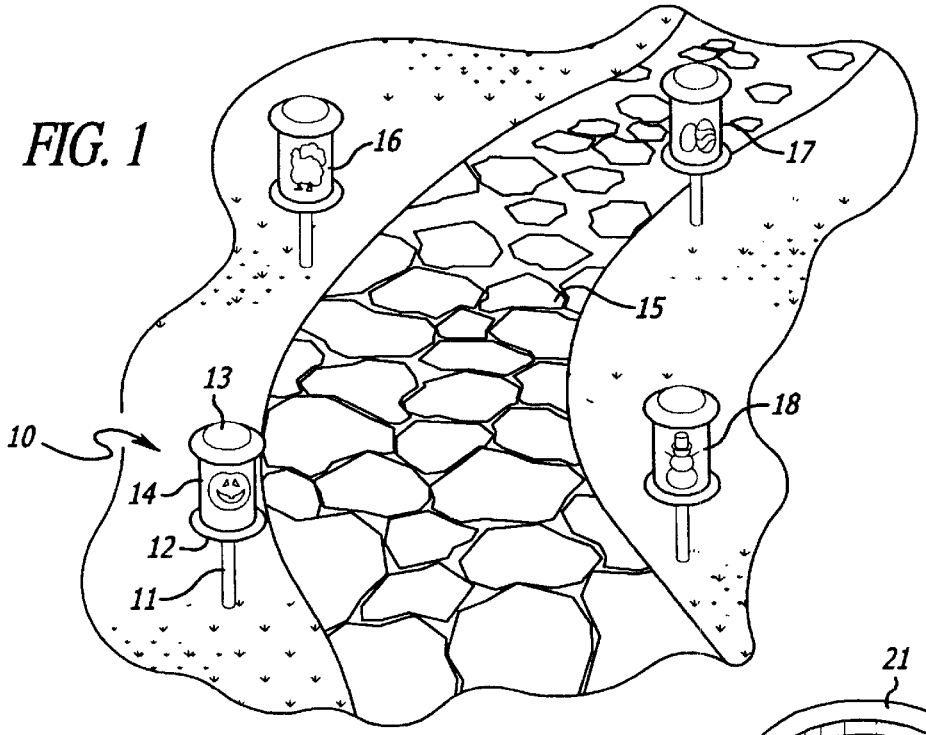
FIG. 2
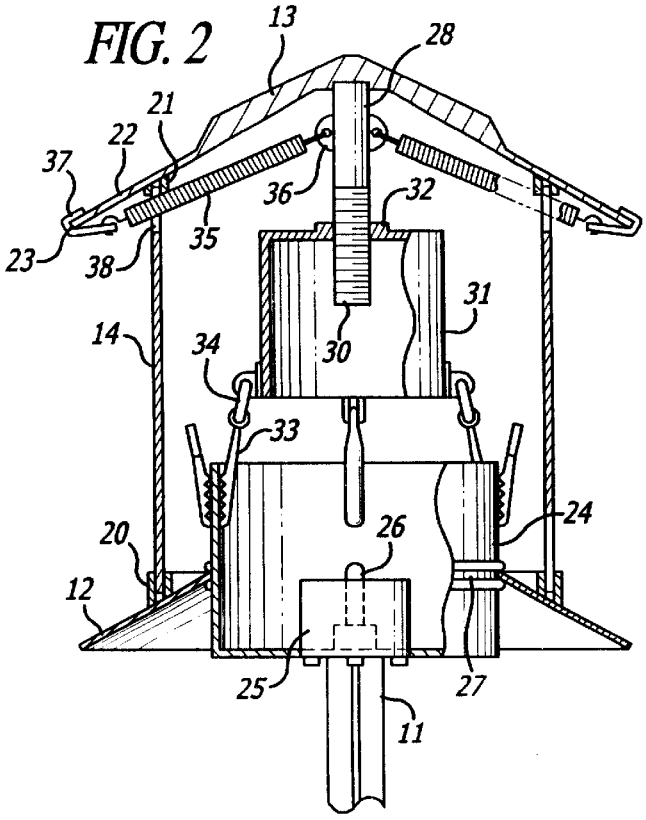
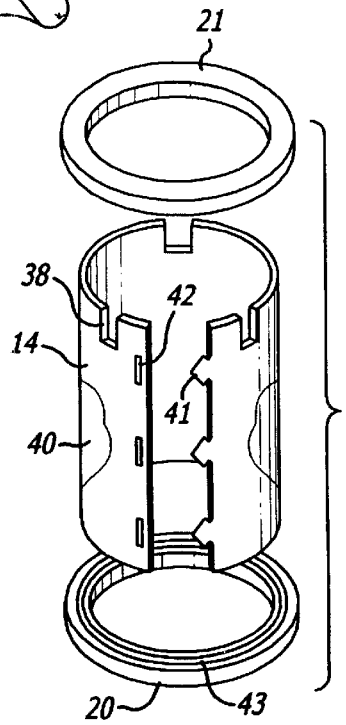
FIG. 3

LOW VOLTAGE DECORATIVE THEME OUTDOOR LIGHTS

This application claims the benefit of provisional application Serial No. 60/301,487 filed Jun. 29, 2001.

BACKGROUND OF THE INVENTION

1. Field of the Invention

The present invention relates to decorative lighting for outdoor purposes, and more particularly to a novel low voltage lamp having interchangeable decorative sleeves which readily mounts a removable hood and a skirt base therebetween.

2. Brief Description of the Prior Art

In the past, it has been the conventional practice to employ outdoor lighting for landscaping purposes and to illuminate walkways. Usually such outdoor lamps are of the low voltage type and are also used to provide safe passage along walkways and to enhance surrounding landscape.

Further, such prior lamps are not usually decorated and are certainly not personalized, so that the degree of decorative appearance is not enhanced or theme continuity is not available. Since a plurality of such outdoor lamps is used in an overall pattern or arrangement, all of the shades surrounding the illumination means are of a unitary or identical appearance and no attempt is made to make a decorative covering or plurality of sleeves representative of particular groups, family members or the like.

Therefore, a long-standing need has existed to provide a low voltage outdoor lamp having interchangeable decorative sleeves which surround the illuminating means, and wherein the decorative display on the sleeves of various lamps in the pattern represent certain graphic representations, personalized family members, or the like. A variety of themes can be portrayed representing festive holidays or selected subject matter. The sleeves should be interchangeable, so that the sleeves on the lamps can be changed.

SUMMARY OF THE INVENTION

Accordingly, the above problems and difficulties are avoided by the present invention which provides a novel low voltage lamp having an internal illumination means which serves as a base for supporting or mounting a detachable hood which is supported on a fixed skirt. The hood and skirt are arranged in spaced-apart relationship and have a diameter which exceeds the diameter of the illumination means and its support. A decorative cylinder or sleeve is mountable between the peripheral edge of the skirt and the edge marginal region of the hood. Spacers may be provided for placing the sleeve between the hood and the skirt while resilient fasteners means detachably couples the hood to a support on the illuminating means support so that the decorative sleeve is releasably held between the hood and the skirt.

The external surface of the sleeve may carry a variety of indicia, pictures or graphic representations. In some instances, such indicia, graphic representations or pictures may be placed on the inside surface so as not to be exposed to the outdoor elements. The illumination means mounting or housing is carried on a support, such as a post or round spike. In one form, the resilient mounting means for the hood will take the form of an expandable helical spring having one end attached to a downwardly depending post from the hood which is in threadable connection with a support body, while the opposite end of the spring is releasably fastened by clips about the peripheral edge of the hood. A further feature for adjustment is provided by employing a plurality of alligator hooks or clamps attached to the support body which can be clipped to the edge of the illumination means mounting, base or housing.

Therefore, it can be seen that by detaching the hood through the hooks of the resilient means and by employing the clips or clamps of the support body to the mounting or housing for the illumination means, the surrounding sleeves may be readily inter changed or alternated with other sleeves having different decorative representations.

Therefore, it is among the primary objects of the present invention to provide a novel low voltage outdoor lamp which has interchangeable decorative sleeves surrounding and coaxially disposed with respect to illumination means.

Another object of the present invention resides in providing a low voltage outdoor lamp having a removable hood which permits a decorative sleeve to be exchanged for another sleeve with different decorative subject matter.

Still a further object of the present invention is to provide a novel means for displaying a variety of festive themes by interchanging sleeves on an outdoor lamp having different exposed decorative representations.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a graphic illustration of several low voltage outdoor lamps used to identify a walkway or passageway and which incorporates interchangeable decorative sleeves in accordance with the present invention;

FIG. 2 is an enlarged longitudinal cross-sectional view of the low voltage lamp employed in the illustration of FIG. 1; and FIG. 3 is a perspective exploded view of the decorative sleeve and mounting grommets therefor.

DESCRIPTION OF THE PREFERRED EMBODIMENT

Referring to FIG. 1, a novel low voltage outdoor lamp incorporating the present invention is illustrated in the general direction of arrow 10 which includes the post or spike 11 on which the lamp is carried. The lamp includes a skirt 12 and a hood 13 that are arranged in spaced-apart relationship and are further separated by means of a decorative sleeve 14. The decorative sleeve includes selected graphics, indicia, photographs or other material which relates to a festive theme for holidays or to a personalized group or family. The walkway is illustrated by numeral 15 while additional lamps are numbered by numerals 16, 17 and 18. The sleeves are interchangeable and may all relate together as a multiplicity to depict a particular festive occasion or family grouping.

Referring now to FIG. 2, it can be seen that the decorative sleeve 14 may be carried on a grommet 20 or or may be supported directly on the skirt 12. The upper end of the sleeve may be retained in an upper grommet 21 or may bear directly against the under side of the hood 13. The hood 13 includes an edge marginal region 22 which terminates in an edge 23.

The skirt 12 is frustro-conical and includes a central opening so as to be mounted on a housing 24 that includes the illumination means 25. The housing 24 is carried directly on the end of the post or spike 11 and surrounds the illumination means 25 which may include a low voltage bulb 26. The external surface of the housing 24 includes a groove 27 into which the upper edge of the skirt 12 is inserted and is retained therein by the opposite sides of the housing defining the groove. It can also be seen that the hood 13 includes a downwardly depending shaft 28 that terminates in a threaded end 30 which is threadably attached to a support body 31 by means of a threaded collar 32. The lower end of the support body 31 includes fasteners such as three alligator clips or clamps such as indicated by numeral 33 that are attached to the bottom of the support body by a universal joint such as a ring and broadly indicated by numeral 34. The clamp or clips 33 are manually attached to the edge of the housing 24 and will readily be attached or detached by manually unclipping or unclamping the clips or hooks.

To retain the decorative sleeve 14 on the skirt 12, the hood 13 further includes a detachable and resilient connecting means that includes a resilient spring 35 having one end attached to the shaft 28 by lug 36 and attached to edge 23 by means of a clip 37. At least three springs and clips are provided to detachably connect the hood to the lamp assembly. It is to be noted that the sleeve 14 includes cutouts, such as cutout 38, in its upper edge in order to accommodate the spring 35.

Referring now in detail to FIG. 3, it can be seen that the sleeve 14 includes decorative or theme subject matter or representations broadly indicated by numeral 40. The graphic representations, indicia or theme information can be of a personalized nature or can relate to festive holidays or the like. The sleeve may be of a continuous cylinder construction or it may be flat and wrapped into a cylinder by having lugs 41 inserted into and coupled with slots 42. The lugs and slots are provided on opposite and opposing sections of the sheet. Also, the grommets 20 and 21 may include internal slots 43 into which the opposite ends of the cylindrical sleeve may be placed preparatory for assembling the lamp.

In view of the foregoing, it can be seen that the interchangeable decorative sleeves of the present invention may be used at the desire of the user to display all sorts of different graphic representations. They may be used together in multiple lamp displays or individually. The hood 13 is readily removable by undoing the hooks 23 about its peripheral edge so that the sleeve 14 is released and may then be removed from its mounting on the skirt 12. The hood can further be detached by further unscrewing the shaft 28 from collar 32. However, in actual practice it is only necessary to raise the hood a short distance whereby the sleeve is then detached. Additional detachment can take place by unclipping the clamps 33 so that the entire top assembly can be removed from the housing 24 and the sleeve can be completely removed.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A low voltage outdoor lamp comprising:

a post having a terminating end;

illumination means disposed on said terminating end;

a skirt carried on said illumination means extending outwardly about said post;

a tapered hood carried on said illumination means via a shaft spaced apart coaxial relationship with respect to said skirt;

a cylindrical sleeve having opposite ends engaging said hood and said skirt respectively; and said sleeve carrying a variety of graphic representations, indicia, and alpha/numeric characters.

2. The low voltage outdoor lamp defined in claim 1 including:

spring fastener means releasably coupling said hood with said shaft.

3. The low voltage outdoor lamp defined in claim 2 wherein:

said spring fastener means includes a clip engageable with an edge of said hood.

4. The low voltage outdoor lamp defined in claim 3 including:

a support structure carried on said illumination means adjustably supporting said hood.

5. The low voltage outdoor lamp defined in claim 4 wherein:

said support structure includes a base threadably coupled with one end of said shaft and an opposite end of said shaft coupled to said hood.

6. The low voltage outdoor lamp defined in claim 5 wherein:

said structure further including housing about said illumination means and a support body releasably connected to said housing by a clamp means; and said housing and said support body being in coaxial spaced-apart relationship.

7. The low voltage outdoor lamp defined in claim 6 including:

sealing grommets resiliently supporting said opposite ends of said sleeve with said hood and said skirt respectively.

* * * * *